US009241544B2

(12) United States Patent
Haas et al.

(10) Patent No.: US 9,241,544 B2
(45) Date of Patent: Jan. 26, 2016

(54) SEAT-BELT LOCK ASSEMBLY

(75) Inventors: Peter Haas, Eschach (DE); Achim Ebert, Backnang (DE)

(73) Assignee: TRW Automotive GmbH, Alfdorf (DE)

( * ) Notice: Subject to any disclaimer, the term of this patent is extended or adjusted under 35 U.S.C. 154(b) by 0 days.

(21) Appl. No.: 14/113,011

(22) PCT Filed: Apr. 18, 2012

(86) PCT No.: PCT/EP2012/001664
§ 371 (c)(1),
(2), (4) Date: Nov. 14, 2013

(87) PCT Pub. No.: WO2012/146356
PCT Pub. Date: Nov. 1, 2012

(65) Prior Publication Data

US 2014/0059815 A1 Mar. 6, 2014

(30) Foreign Application Priority Data

Apr. 29, 2011 (DE) ..... 10 2011 100 072

(51) Int. Cl.
*A44B 11/25* (2006.01)

(52) U.S. Cl.
CPC ..... *A44B 11/2507* (2013.01); *A44B 11/2523* (2013.01); *A44B 11/2561* (2013.01); *A44B 11/2569* (2013.01); *Y10T 24/45* (2015.01)

(58) Field of Classification Search
CPC ..... B60R 22/30; B60R 21/18; B60R 22/023; A44B 11/2507; A44B 11/2523; A44B 11/2561; A44B 11/2569; Y10T 24/45
USPC ..... 24/584.1, 572.1, 589.1, 593.1, 629, 24/633, 636, 637, 640, 641, 579.11
See application file for complete search history.

(56) References Cited

U.S. PATENT DOCUMENTS

| | | | | |
|---|---|---|---|---|
| 2,904,866 | A | 9/1959 | Carter | |
| 3,308,516 | A | 3/1967 | Mullan | |
| 6,328,386 | B1 * | 12/2001 | Good | 297/483 |
| 6,442,807 | B1 * | 9/2002 | Adkisson | 24/633 |
| 7,370,393 | B2 * | 5/2008 | Hlavaty et al. | 24/633 |
| 2007/0000104 | A1 * | 1/2007 | Zelmer | 24/633 |

FOREIGN PATENT DOCUMENTS

| | | |
|---|---|---|
| DE | 38 38 755 | 5/1990 |
| DE | 201 13 868 | 7/2002 |
| WO | 01/67910 | 9/2001 |
| WO | 2012/069110 | 5/2012 |

* cited by examiner

*Primary Examiner* — Robert J Sandy
*Assistant Examiner* — Michael Lee
(74) *Attorney, Agent, or Firm* — Tarolli, Sundheim, Covell & Tummino LLP

(57) ABSTRACT

A belt buckle assembly, especially for a seat belt system in a motor vehicle, includes a belt buckle (10) and a plug-in tongue (12) lockable in the belt buckle (10) by means of a locking mechanism. A component of the locking mechanism of the belt buckle (10) interacting with the plug-in tongue (12) inside the belt buckle (10) and/or the plug-in tongue (12) has/have design features at a locking portion (16) interacting with the locking mechanism of the belt buckle (10) inside the belt buckle (10). The design features enable the plug-in tongue (12) to be locked in the belt buckle (10) only at one of at least two possible orientations of the plug-in tongue (12) in the belt buckle (10).

15 Claims, 4 Drawing Sheets

SEAT-BELT LOCK ASSEMBLY

RELATED APPLICATIONS

This application corresponds to PCT/EP2012/001664, filed Apr. 18, 2012, which claims the benefit of German Application No. 10 2011 100 072.4, filed Apr. 29, 2011, the subject matter, of which are incorporated herein by reference in their entirety.

BACKGROUND OF THE INVENTION

The invention relates to a belt buckle assembly, especially for a seat belt system in a motor vehicle, comprising a belt buckle and a plug-in tongue lockable in the belt buckle.

So far it has been common practice in seat belt systems in motor vehicles that the plug-in tongue of a seat belt can be inserted into and also locked in a corresponding belt buckle at two different orientations. More exactly speaking, the planar plug-in tongue can be inserted into and locked in a slit of the belt buckle at a first orientation or at a second orientation rotated by 180° with respect thereto (relative to the inserting direction).

Such "freedom" of orientation on the one hand has the advantage that when fastening the seat belt the vehicle occupant need not pay attention at which of the two orientations he/she inserts the plug-in tongue into the belt buckle. On the other hand, one of the two possible orientations necessarily entails an undesired twisting of the webbing. Twisting of the webbing does not only result in a loss of comfort, but in this case an optimum contact of the seat belt with respect to the safety of the vehicle occupant is not ensured, either.

Another drawback is resulting for plug-in tongues having a curvature or offset. If the plug-in tongue is inserted into the belt buckle at the wrong orientation, a press button for releasing the locked plug-in tongue arranged next to the inserting slit of the belt buckle is no longer just freely accessible, because the curvature or offset projects above the press button.

DE 38 38 755 A1 illustrates a generic belt buckle assembly in which a buckle tongue is movably supported on a tongue member. The buckle tongue is displaced via an operating element disposed at the tongue member. When the tongue member fully contacts the buckle housing, the operating element is pressed or pushed into the tongue member so that the buckle tongue is pushed or pressed out sufficiently far so that the buckle tongue can be locked in the belt buckle. In a specific embodiment of the known belt buckle assembly plural end pieces provided separately from the belt buckle are provided for shoulder belts and a crotch strap. Due to their recesses adapted to the shape of a shoulder of the buckle tongue the end pieces can be slipped onto the shoulder only in a particular order. In this case the operating element does not contact the belt buckle but a particular one of the end pieces disposed between the belt buckle and the plug-in tongue.

From DE 201 13 868 U1 a plug-in tongue is known which in a transition area between a locking portion adapted to be inserted into a belt buckle and a retaining portion on which a seat belt can be mounted has an encoding projection. Thus the plug-in tongue can be inserted only into a belt buckle associated therewith which is provided with a corresponding recess for the encoding projection. In this way mix-up of the corresponding plug-in tongues is to be excluded in the case of belt buckles that are located next to each other.

SUMMARY OF THE INVENTION

It is the object of the invention, while eliminating the afore-described drawbacks, to provide a belt buckle assembly by which a preferred orientation of the plug-in tongue is easily provided for the vehicle occupant.

This object is achieved by a belt buckle assembly comprising the features of claim 1. Advantageous and expedient configurations of the belt buckle assembly according to the invention are described in the subclaims.

The belt buckle assembly according to the invention is provided especially for a seat belt system in a motor vehicle and comprises a belt buckle and a plug-in tongue lockable in the belt buckle by means of a locking mechanism. In this case, a component of the locking mechanism of the belt buckle interacting with the plug-in tongue inside the belt buckle and/or the plug-in tongue include/s, at a locking portion interacting inside the belt buckle with the locking mechanism of the belt buckle, design features allowing for locking the plug-in tongue in the belt buckle only at one of at least two possible orientations of the plug-in tongue in the belt buckle.

The belt buckle assembly according to the invention ensures by simple means that the plug-in tongue can be inserted into and locked in the belt buckle only at a particular orientation. By reason of the special design of the component of the locking mechanism and/or the plug-in tongue any "false operation", viz. locking at a different orientation of the plug-in tongue, is excluded. Thus, a twisting by 180° of the seat belt as in the previously known belt buckle assemblies and, in the case of a curved or offset plug-in tongue, an undesired orientation of the curvature or offset with respect to the ejecting button and the vehicle occupant cannot occur.

According to a preferred embodiment of the belt buckle assembly according to the invention, the component of the locking mechanism is an ejector. Usually the ejector of a belt buckle is in direct contact with the plug-in tongue when inserting the plug-in tongue into the belt buckle. Thus, by providing the design features according to the invention at the ejector and/or at the plug-in tongue it can be safeguarded without great structural effort that the predetermined orientation of the plug-in tongue is observed.

Concretely speaking, the component of the locking mechanism and the plug-in tongue can exhibit two contours as design features which are adjusted to each other so that the contours interact only at the one orientation of the plug-in tongue in the belt buckle in a way that enables the plug-in tongue to be locked in the belt buckle.

Preferably the two contours are arranged asymmetrically with respect to a central axis of the belt buckle and the plug-in tongue, respectively. The asymmetric arrangement of the contours is adapted to safely exclude locking of the plug-in tongue at an orientation twisted by 180° with respect to the desired orientation.

In an embodiment of the invention which can be realized in an especially simple manner the first contour is a recess and the second contour is a bulge complementary to said recess. In this case locking is possible only when the bulge comes to rest in the recess. Otherwise the plug-in tongue cannot be inserted far enough into the belt buckle so that locking is not possible.

In accordance with a particular aspect of the invention, the belt buckle comprises an ejecting button and the plug-in tongue includes a retaining portion at which a seat belt can be arranged. The retaining portion is inclined vis-à-vis the locking portion, wherein the direction of inclination with respect to the ejecting button depends on the orientation of the plug-in tongue in the belt buckle. The inclination of the retaining portion is intended to point always toward the vehicle occupant when the plug-in tongue is inserted so as to assist an optimum tight contact of the seat belt. The ejecting button of a belt buckle therefore is usually arranged on the side facing away from the vehicle occupant. The given orientation of the plug-in tongue obtained according to the invention ensures that the retaining portion does not project above the ejecting button so that the latter is freely accessible in any case.

BRIEF DESCRIPTION OF THE DRAWINGS

Further features and advantages of the invention are resulting from the following description and from the enclosed drawings which are referred to and in which.

DESCRIPTION OF EXEMPLARY EMBODIMENT

Figure 2:
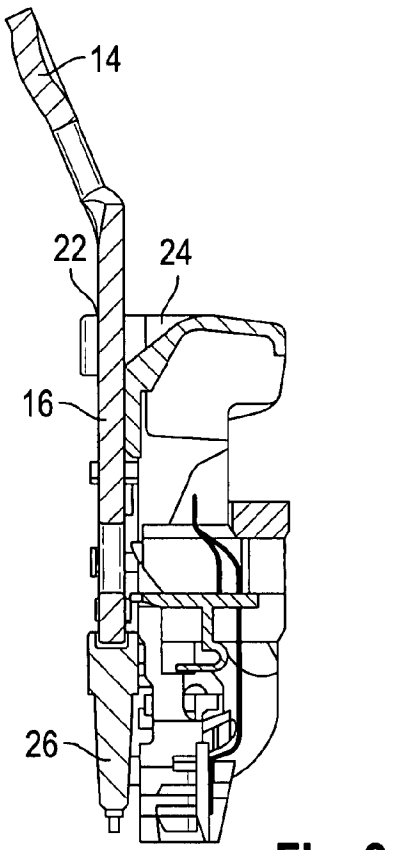
FIG. 2 shows the belt buckle assembly of FIG. 1 in a sectional side view rotated by 90°.
Figure 1:
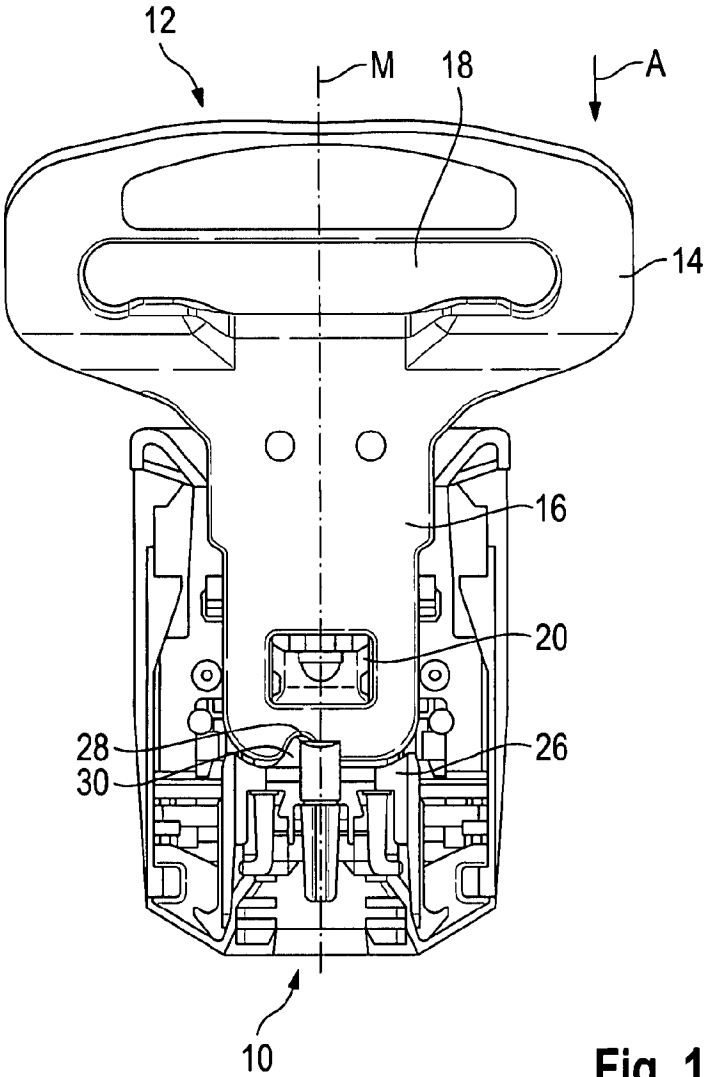
FIG. 1 shows a belt buckle assembly according to the invention in a sectional side view with a plug-in tongue inserted at a first orientation.

FIGS. 1 and 2 illustrate a belt buckle assembly for a seat belt system in an automotive vehicle comprising a belt buckle 10 and a plug-in tongue 12 locked therein.

The plug-in tongue 12 includes a retaining portion 14 and a locking portion 16. The retaining portion 14 has an opening slit 18 for a seat belt by which a vehicle occupant can buckle up. The locking portion 16 of the plug-in tongue 12 includes an opening slit 20 and serves for being inserted into the belt buckle 10 and for being locked there. Between the retaining portion 14 and the locking portion 16 a curvature is provided so that the retaining portion 14 is inclined vis-à-vis the locking portion 16. In particular when the seat belt is designed as an inflatable belt, the retaining portion 14 absolutely has to be inclined toward the vehicle occupant in the locked state of the belt buckle assembly.

The belt buckle 10 includes an inserting passage for the plug-in tongue 12 opening into an inserting slit 22. Next to the inserting slit 22, more exactly speaking on one of the two longitudinal sides of the inserting slit 22, an ejecting button 24 operable in the inserting direction A is arranged. Inside the belt buckle 10 a locking mechanism including a bar (not separately shown here) is provided which is automatically guided through the opening 20 of the locking portion 16 of the plug-in tongue 12 when the plug-in tongue 12 is inserted far enough into the belt buckle 10. Moreover, the locking mechanism comprises an ejector 26 arranged in the inserting passage of the belt buckle 10 and adapted to be pre-tensioned against the force of a spring (not shown here).

Figure 3:
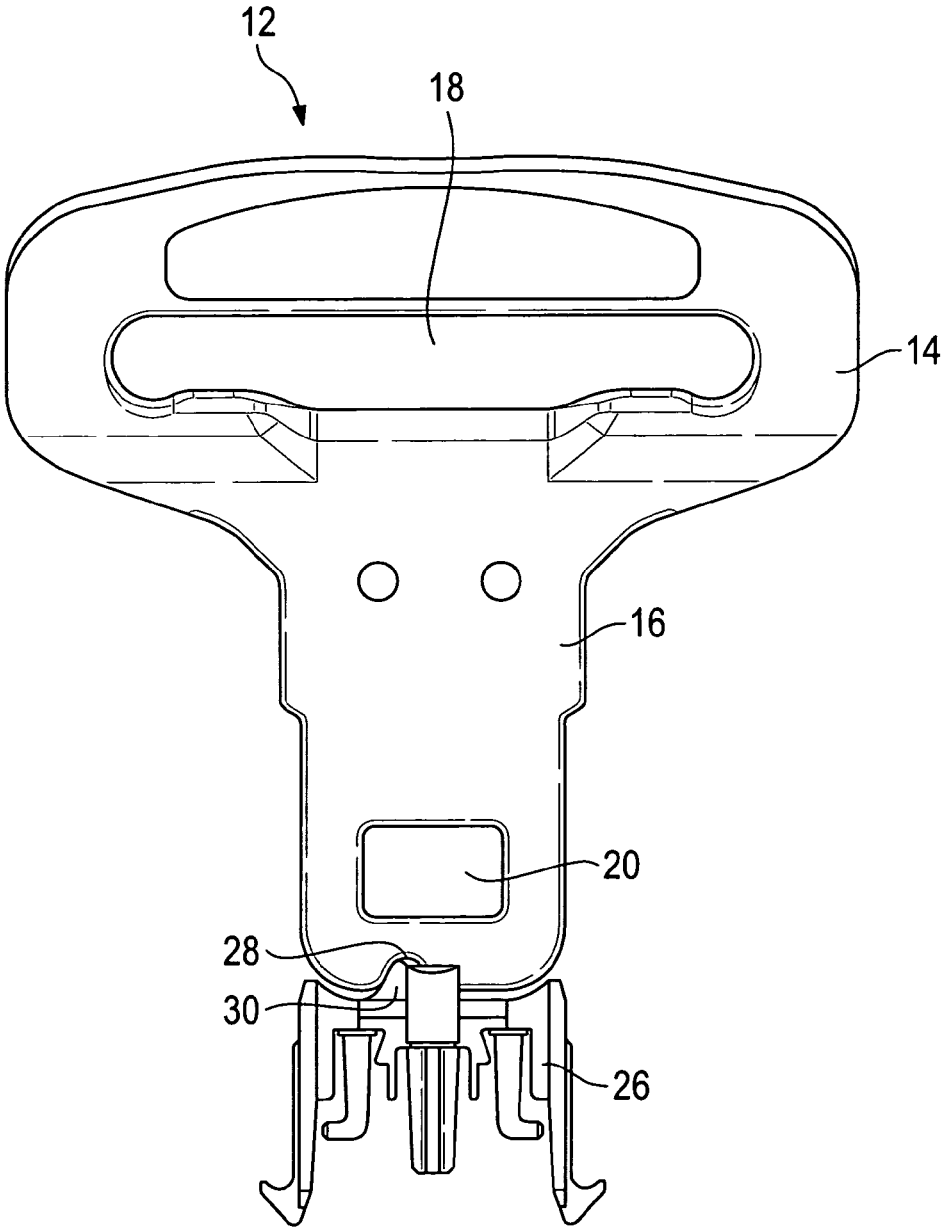
FIG. 3 is a separate representation of the plug-in tongue and of the ejector of the belt buckle assembly of FIG. 1.

As can be best recognized in the representation of FIG. 3, a particular first contour 28 is provided at the plug-in tongue 12, more exactly speaking at the locking portion 16 thereof. The first contour 28 in this case is in the form of a recess at the end face of the free end of the locking portion 16 opposed to the retaining portion 14. The ejector 26 has a second contour 30 matching with the first contour 28 of the plug-in tongue 12. The second contour 30 in this case is in the form of a bulge at the end face of the ejector 26 pointing to the inserting slit 22. The contours 28, 30 complementary to each other are arranged asymmetrically with respect to the central axis M of the plug-in tongue 12 and the belt buckle 10, respectively.

When the plug-in tongue 12 is inserted in the inserting passage of the belt buckle 10 through the inserting slit 22 at a first orientation as shown in FIGS. 1 to 3, the bulge of the ejector 26 comes to rest in the recess of the locking portion 16. This entails that the plug-in tongue 12 directly contacts the opposing free end face of the ejector 26 over the entire width of its free end face. In this constellation the plug-in tongue 12 can be inserted into the belt buckle 10 until it is automatically locked. By pressing the ejecting button 24 the locking is released again and the ejector 26 pre-tensioned against the force of the spring automatically conveys the plug-in tongue 12 out of the inserting passage of the belt buckle 10.

Figure 5:
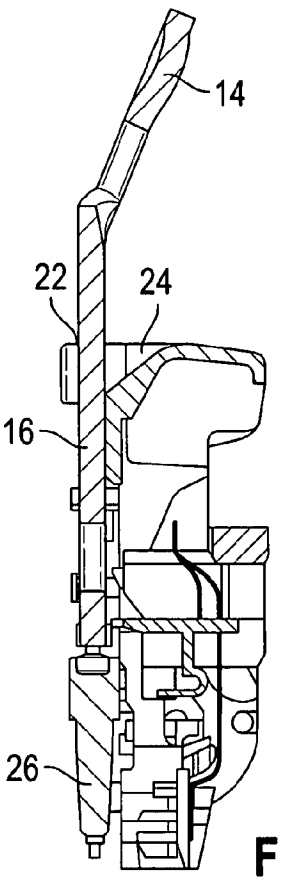
FIG. 5 shows the belt buckle assembly according to FIG. 4 in a sectional side view rotated by 90°.
Figure 4:
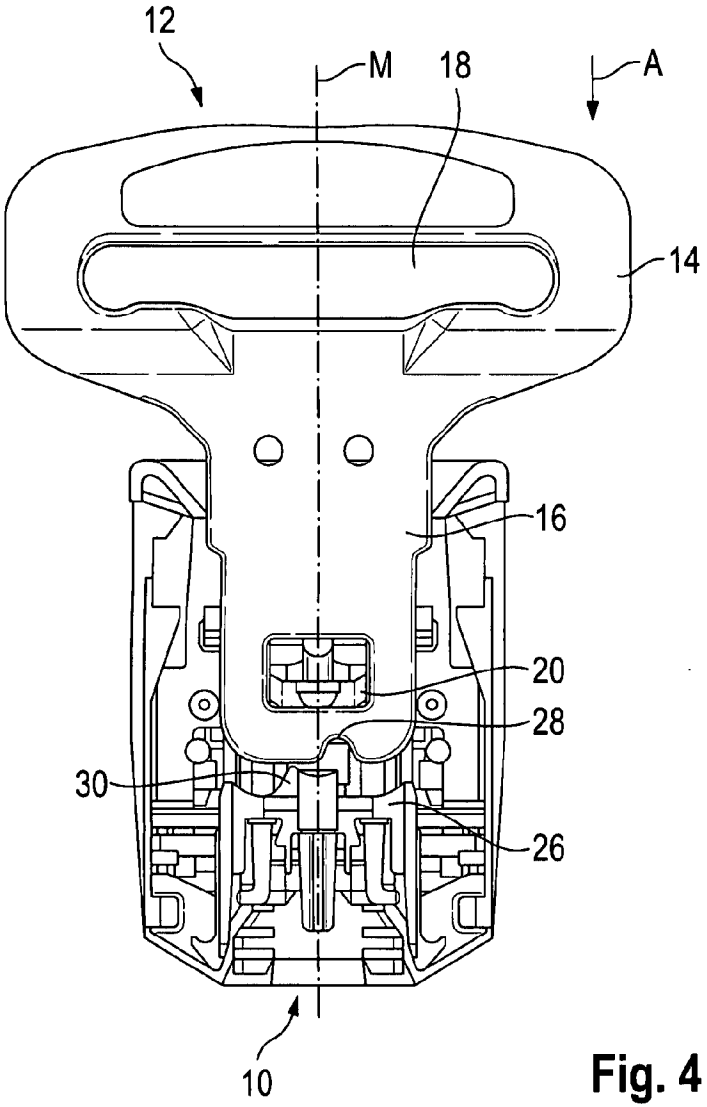
FIG. 4 shows the belt buckle assembly of FIG. 1 with a plug-in tongue inserted at a second orientation.
Figure 6:
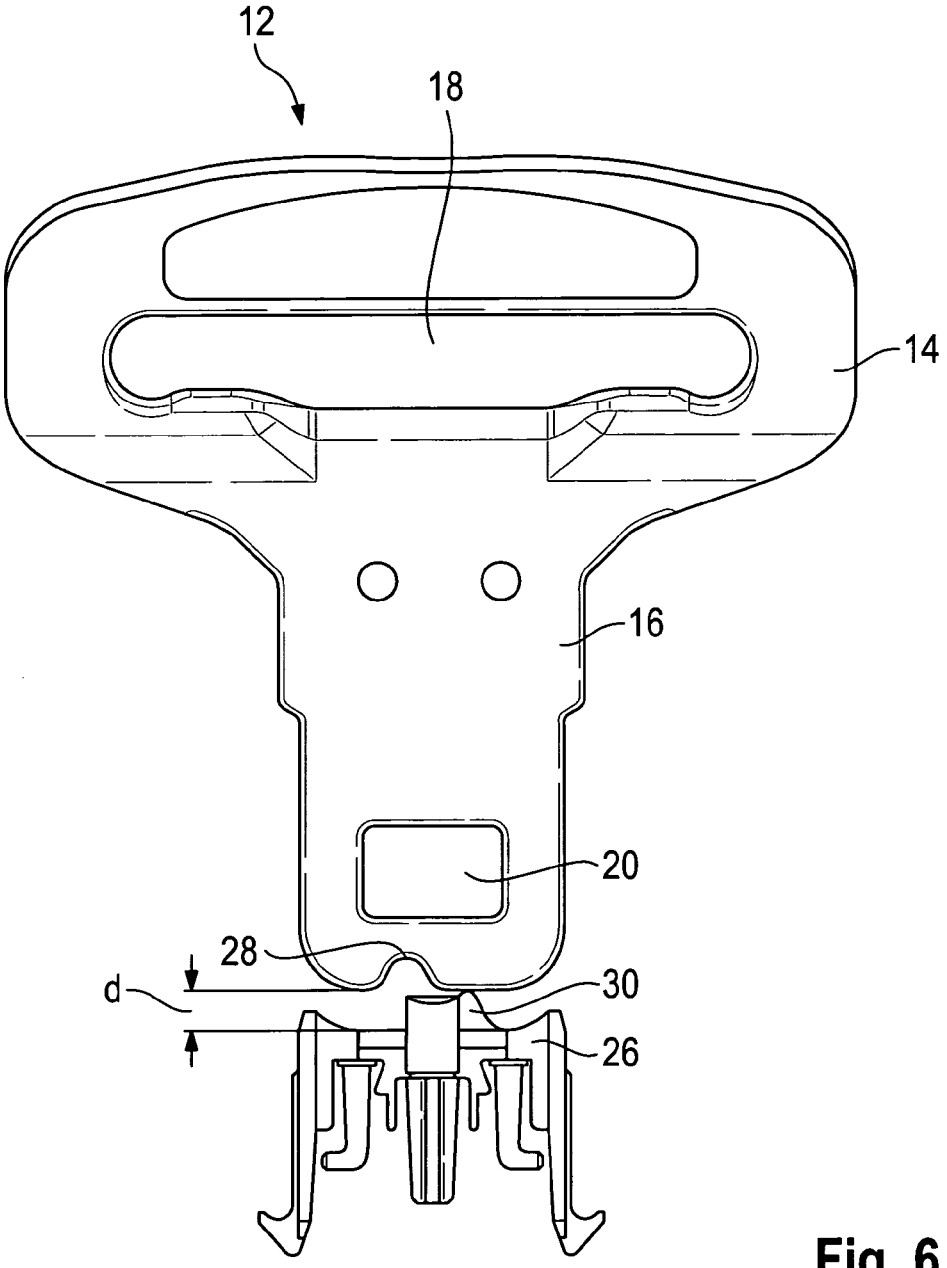
FIG. 6 is a separate representation of the plug-in tongue and of the ejector of the belt buckle assembly according to FIG. 4.

In FIGS. 4 to 6 the same belt buckle assembly is shown as in FIGS. 1 to 3 with the difference that the plug-in tongue 12 has an orientation relative to the belt buckle 10 that is rotated by 180° with respect to the central axis M and the inserting direction A, respectively. At said second orientation the bulge of the ejector 26 does not come to rest in the recess of the plug-in tongue 12 due to the asymmetric arrangement so that when being inserted into the belt buckle 10 the plug-in tongue 12 has a distance d from the ejector 26 (cf. FIG. 6). This distance is responsible for the fact that the plug-in tongue 12 can be inserted into the belt buckle only so far that locking is not possible.

Thus the special design features in the form of the contours 28, 30 ensure that the plug-in tongue 12 can be locked in the belt buckle 10 only at the first orientation.

As can be inferred from FIGS. 1 to 3, the first orientation is selected so that, when the plug-in tongue 12 is locked, the retaining portion 14 thereof is inclined away from the ejecting button 24. The ejecting button 24 is thus freely accessible for the vehicle occupant. The belt buckle 10 is arranged in the motor vehicle such that after inserting and locking the plug-in tongue 12 the retaining portion 14 is inclined toward the vehicle occupant.

As a matter of course, the bulge and the recess can be exchanged, i.e. the bulge can be provided at the plug-in tongue 12 when the matching recess then is formed at the ejector 26. Basically also other contours matching with each other are possible, if at the first orientation of the plug-in tongue 12 they ensure closer contact of the plug-in tongue 12 with the ejector 26 than at the second orientation of the plug-in tongue 12.

LIST OF REFERENCE NUMERALS

10 belt buckle
12 plug-in tongue
14 retaining portion
16 locking portion
18 opening slit
20 opening
22 inserting slit
24 ejecting button
26 ejector
28 first contour
30 second contour

The invention claimed is:

1. A belt buckle assembly, especially for a seat belt system in a motor vehicle, comprising:

a belt buckle provided with a locking mechanism and a plug-in tongue lockable by means of the locking mechanism, the plug-in tongue including a retaining portion for receiving a seat belt and a locking portion having a free end insertable into the belt buckle, the locking portion including an opening slit having a first edge spaced apart from the free end by a first distance and a second edge spaced apart from the free end by a second distance, the first distance being less than the second distance, wherein a component of the locking mechanism of the belt buckle interacting with the plug-in tongue inside the belt buckle and a component of the plug in tongue each have a contour interacting inside the belt buckle, each contour matching with each other such that the contours interact only at one orientation of at least two possible orientations of the plug-in tongue in the belt buckle in a way that allows for locking the plug-in tongue in the belt buckle, and in another one of the at least two possible orientations of the plug-in tongue in the belt buckle the two contours interact in a way that limits insertion of the plug-in tongue in the belt buckle, a first contour of the two contours being provided in an area of the locking portion located between the second edge and the free end.

2. The belt buckle assembly according to claim 1, wherein the component of the locking mechanism includes an ejector (26).

3. The belt buckle assembly according to claim 2, wherein the two contours (28, 30) are arranged asymmetrically with respect to a central axis (M) of the belt buckle (10) and of the plug-in tongue (12), respectively.

4. The belt buckle assembly according to claim 1, wherein the first contour (28) is a recess and the second contour (30) is a bulge complementary to the recess.

5. The belt buckle assembly according to claim 1, wherein the belt buckle (10) comprises an ejecting button (24) and the plug-in tongue (12) has a retaining portion (14) to which a seat belt can be attached, wherein the retaining portion (14) is inclined vis-à-vis the locking portion (16) and the direction of inclination with respect to the ejecting button (24) depends on the orientation of the plug-in tongue (12) in the belt buckle (10).

6. The belt buckle assembly accordingly to claim 2, wherein a first contour is located on an edge of the plug-in tongue that engages the ejector when the plug-in tongue is inserted in the belt buckle.

7. The belt buckle assembly according to claim 1, wherein a profile of a first contour mirrors a profile of a second contour.

8. The belt buckle assembly according to claim 2, wherein the ejector is configured to convey the plug-in tongue out of the belt buckle when an ejecting button is depressed.

9. A belt buckle assembly comprising:

a belt buckle;

a plug-in tongue including a retaining portion for receiving a seat belt and a locking portion having a free end insertable into the belt buckle, the locking portion including an opening slit having a first edge spaced apart from the free end by a first distance and a second edge spaced apart from the free end by a second distance, the first distance being less than the second distance;

a locking mechanism provided in the belt buckle for locking the plug-in tongue to the belt buckle; and at least two contours, one of the at least two contours being provided on the plug-in tongue in an area of the locking portion located between the second edge and the free end, and one other of the at least two contours being provided on the locking mechanism;

the plug-in tongue being insertable into the belt buckle in at least two possible orientations, in one orientation of the at least two possible orientations the at least two contours being engaged such that the locking mechanism locks the plug-in tongue to the belt buckle, and in another one of the at least two possible orientations the at least two contours being disengaged to limit insertion of the plug-in tongue into the belt buckle.

10. The belt buckle assembly according to claim 9, wherein one of the at least two contours is provided on an ejector of the locking mechanism.

11. The belt buckle assembly according to claim 9, wherein the at least two contours are arranged asymmetrically with respect to a longitudinal central axis of the belt buckle and a longitudinal central axis of the plug-in tongue, respectively.

12. The belt buckle assembly according to claim 9, wherein a first contour of the at least two contours is a recess and a second contour of the at least two contours is a bulge complementary to the recess.

13. The belt buckle assembly according to claim 10, wherein a first contour of the at least two contours is located on an edge of the plug-in tongue that engages the ejector when the plug-in tongue is inserted in the belt buckle.

14. The belt buckle assembly according to claim 9, wherein a profile of a first contour of the at least two contours mirrors a profile of a second contour of the at least two contours.

15. The belt buckle assembly according to claim 10, wherein the ejector is configured to convey the plug-in tongue out of the belt buckle when an ejecting button is depressed.

* * * * *